US009642773B2

(12) United States Patent
Gelbaum

(10) Patent No.: US 9,642,773 B2
(45) Date of Patent: May 9, 2017

(54) OVERLAY FOR MEDICATION CARD

(71) Applicant: CHIASMA INC., Newton Centre, MA (US)

(72) Inventor: Dana Gelbaum, Tel Aviv (IL)

(73) Assignee: CHIASMA INC., Waltham, MA (US)

( * ) Notice: Subject to any disclaimer, the term of this patent is extended or adjusted under 35 U.S.C. 154(b) by 23 days.

(21) Appl. No.: 14/612,873

(22) Filed: Feb. 3, 2015

(65) Prior Publication Data

US 2016/0220443 A1 Aug. 4, 2016

(51) Int. Cl.

| | |
|---|---|
| ***B65D 75/36*** | (2006.01) |
| ***A61J 1/03*** | (2006.01) |
| ***B65B 61/02*** | (2006.01) |
| ***B65D 25/20*** | (2006.01) |
| ***B65D 75/32*** | (2006.01) |
| ***A61J 7/04*** | (2006.01) |

(52) U.S. Cl.

CPC ..... *A61J 1/035* (2013.01); *A61J 7/04* (2013.01); *B65B 61/025* (2013.01); *B65D 25/205* (2013.01); *B65D 75/327* (2013.01); *A61J 2205/20* (2013.01); *A61J 2205/50* (2013.01)

(58) Field of Classification Search

CPC ..... B65D 75/36; B65D 75/327; A61J 1/035
USPC ..... 206/531, 528, 534
See application file for complete search history.

(56) References Cited

U.S. PATENT DOCUMENTS

| | | | | |
|---|---|---|---|---|
| 3,958,690 A | | 5/1976 | Gee, Sr. | |
| 4,084,695 A | | 4/1978 | Halbich | |
| 4,253,572 A | | 3/1981 | Halbich | |
| 4,372,445 A | | 2/1983 | Keffeler | |
| 4,384,649 A | | 5/1983 | Brodsky | |
| 4,416,375 A | * | 11/1983 | Braverman | B65D 75/327 206/459.5 |
| 4,429,792 A | | 2/1984 | Machbitz | |
| 4,553,670 A | * | 11/1985 | Collens | A61J 1/035 116/308 |
| 4,664,262 A | * | 5/1987 | White | A61J 1/035 206/531 |
| 5,014,851 A | * | 5/1991 | Wick | A61J 1/035 206/461 |
| 5,377,839 A | | 1/1995 | Relyea et al. | |
| 5,603,409 A | * | 2/1997 | Braverman | G09F 3/0288 206/459.5 |

(Continued)

OTHER PUBLICATIONS

MeadWestvaco Corporation, Dosepak® Medication Adherence Packaging, http://mwv.com/en-us/healthcare/products/dosepak-medication-adherence-packaging, 2015.

(Continued)

*Primary Examiner* — King M Chu

(74) *Attorney, Agent, or Firm* — Lando & Anastasi, LLP

(57) ABSTRACT

An overlay is provided for a medication card of the type having a plurality of pharmaceutical products arranged in at least one row. The overlay includes a planar body having a front surface, and a plurality of openings formed in the planar body, with locations of the plurality of openings substantially corresponding to locations of the plurality of products of the medication card. The overlay further includes instructions provided on the front surface of the body for ingesting the plurality of products of the medication card.

11 Claims, 6 Drawing Sheets

(56) References Cited

U.S. PATENT DOCUMENTS

| | | | | |
|---|---|---|---|---|
| 5,791,478 | A * | 8/1998 | Kalvelage | A61J 1/035 206/531 |
| 6,023,916 | A * | 2/2000 | Bouthiette | A61J 7/0069 206/534 |
| 6,082,544 | A | 7/2000 | Romick | |
| 6,338,408 | B1 * | 1/2002 | Anderson | A61J 1/035 206/1.5 |
| D546,198 | S | 7/2007 | Currie et al. | |
| D562,153 | S | 2/2008 | Ruble et al. | |
| 7,328,801 | B2 | 2/2008 | Iossi | |
| 7,389,875 | B2 | 6/2008 | Sandberg et al. | |
| 7,762,399 | B2 * | 7/2010 | Bouthiette | A61J 1/035 206/484.2 |
| D622,158 | S | 8/2010 | Proulx | |
| 7,937,911 | B1 | 5/2011 | McGonagle et al. | |
| 8,100,262 | B2 | 1/2012 | Jones | |
| D658,991 | S | 5/2012 | Schmitz et al. | |
| 8,240,084 | B2 * | 8/2012 | Cope | B65D 5/503 47/87 |
| D684,482 | S | 6/2013 | Stevens | |
| D723,390 | S | 3/2015 | Eriksson et al. | |
| 2004/0026293 | A1 * | 2/2004 | Hughes | B65B 15/00 206/538 |
| 2004/0148054 | A1 | 7/2004 | Schwartz | |
| 2005/0044762 | A1 | 3/2005 | Atluri | |
| 2006/0086639 | A1 * | 4/2006 | Priebe | B65B 5/068 206/528 |
| 2006/0144747 | A1 * | 7/2006 | Le | A61J 7/0481 206/531 |
| 2007/0068843 | A1 * | 3/2007 | Hession | B65D 5/0227 206/538 |
| 2008/0093252 | A1 | 4/2008 | Hession | |
| 2008/0241226 | A1 | 10/2008 | Abeln et al. | |
| 2009/0283438 | A1 * | 11/2009 | Bourque | A61J 1/03 206/531 |
| 2010/0096292 | A1 | 4/2010 | Jones | |
| 2010/0108559 | A1 * | 5/2010 | Kohl | A61J 1/035 206/531 |
| 2010/0108677 | A1 | 5/2010 | Loftin et al. | |
| 2013/0037436 | A1 | 2/2013 | Wagner et al. | |

OTHER PUBLICATIONS

MeadWestvaco Corporation, Dosepak Express® with Optilock® technology, http://mwv.com/en-us/healthcare/products/dosepak-express-with-optilock-technology, 2015.

Notification of Transmittal of the International Search Report and the Written Opinion of the International Searching Authority from corresponding PCT/US2016/016326 dated Apr. 8, 2016.

* cited by examiner

OVERLAY FOR MEDICATION CARD

RELATED APPLICATIONS

This application relates to U.S. patent application Ser. No. 62/111,369 entitled METHOD OF TREATING ACROMEGALY, by Roni Mamluk, and to U.S. Design patent application Ser. No. 29/516,534 entitled OVERLAY FOR MEDICATION CARD, now U.S. Pat. No. D770,303, by Dana Gelbaum, both of which are filed on even date herewith and incorporated herein by reference.

BACKGROUND OF DISCLOSURE

1. Field of Disclosure

This disclosure relates generally to packaging for pharmaceutical products, and more particularly to an overlay that can be applied to a medication card to provide dosage instructions to the user.

2. Discussion of Related Art

Packaging for dispensing pharmaceutical products includes a variety of presentation options. Reference can be made to U.S. Pat. Nos. 3,958,690, 4,084,695, 4,253,572, 4,372,445, 4,384,649, 5,377,839 and 6,082,544 and to U.S. Patent Application Publication No. 2013/0037436 A1 for examples of known medicinal dispensing systems. One type of medicinal dispensing system includes a medication wallet having one or more, e.g., two, three, four or even more blisters that encapsulate pills or capsules, and the like. A typical medication wallet has an outer card or cover, an inner card that is sometimes referred to as a medication card, and one or more blisters containing pharmaceutical products. One type of configuration is a 28-capsule blister having four rows of capsules, each row having seven capsules for each day of the week.

One issue facing pharmaceutical manufacturers and pharmacies with medicines employing wallets is that patients requiring the same medicine often need a different dosage amount. Thus, manufacturers are required to create different wallets to support different dosage amounts although using the same drug product. In addition, pharmacies are forced to order mass quantities of the same drug product in wallets having differing dosage amounts, thereby raising the risk that a particular dosage amount may expire if not used in time. The numerous presentations of the same drug product may also contribute to confusion during the dispensing of the drug product to the patient since differences on the outer package may be difficult to differentiate from one to another. Another issue is that the medicine provided in the medication wallets is disseminated in multiple countries having different languages and requiring different country-specific regulatory language. Thus, the medication wallet must include instructions in multiple languages and contain country-specific regulatory language thereby forcing pharmaceutical manufacturers to print medication wallets directed to these country-specific applications.

SUMMARY OF DISCLOSURE

One aspect of the present disclosure is directed to an overlay for a medication card of the type having a plurality of pharmaceutical products arranged in at least one row. In one embodiment, the overlay comprises a planar body having a front surface, and a plurality of openings formed in the planar body, with locations of the plurality of openings substantially corresponding to locations of the plurality of products of the medication card. The overlay further comprises instructions provided on the front surface of the body for ingesting the plurality of products of the medication card.

Embodiments of the overlay further may include providing a medicine card that is unprinted or partially unprinted. The instructions may include written instructions printed on the front surface of the planar body. The instructions may relate to a dosage amount. The instructions further may include color coded instructions printed on the front surface of the planar body. The color coded instructions may include a first color to designate a first subset of the plurality of products to be ingested during a first time period and a second color to designate a second subset of the plurality of products to be ingested during a second time period. The first color may include at least two shades of the first color to designate separate days of the week. The second color may include at least two shades of the second color to designate separate days of the week. The instructions further may include at least one symbol printed on the front surface of the planar body. The at least one symbol may designate one of a first time period and a second time period. Each of the plurality of openings may be sized to enable a product to extend through the opening. The overlay can be configured for different dosages. The overlay further may include an adhesive layer applied on a back surface of the planar body, the adhesive layer being configured to secure the planar body to the medication card. The planar body may have an outer periphery substantially corresponding to an outer periphery of the medication card.

Another aspect of the present disclosure is directed to a method of providing instructions and a recommended dosage amount on a medication card of the type having a plurality of pharmaceutical products arranged in at least one row. In one embodiment, the method comprises: placing an overlay over the medication card, the overlay including a planar body having a front surface, a plurality of openings formed in the planar body, locations of the plurality of openings substantially corresponding to locations of the plurality of products of the medication card, and instructions provided on the front surface of the body for ingesting the plurality of products of the medication card; and identifying a dosage amount from the instructions.

Embodiments of the method further may include providing a medicine card that is unprinted or partially unprinted. Placing the overlay over the medication card may include aligning the plurality of openings of the overlay with the plurality of products of the medication card so that the plurality of products extends through the plurality of openings. The method further may include securing the overlay to the medication card. The overlay may be secured to the medication card by adhesive. The instructions may include written instructions printed on the front surface of the planar body of the overlay. The instructions further may include color coded instructions printed on the front surface of the planar body of the overlay. The color coded instructions may include a first color to designate a first subset of the plurality of products to be ingested during a first time period and a second color to designate a second subset of the plurality of products to be ingested during a second time period. The first color may include at least two shades of the first color to designate separate days of the week and the second color includes at least two shades of the second color to designate separate days of the week.

BRIEF DESCRIPTION OF DRAWINGS

Various aspects of at least one embodiment are discussed below with reference to the accompanying figures, which are not intended to be drawn to scale. Where technical features in the figures, detailed description or any claim are followed by references signs, the reference signs have been included for the sole purpose of increasing the intelligibility of the figures, detailed description, and claims. Accordingly, neither the reference signs nor their absence are intended to have any limiting effect on the scope of any claim elements. In the figures, each identical or nearly identical component that is illustrated in various figures is represented by a like numeral. For purposes of clarity, not every component may be labeled in every figure. The figures are provided for the purposes of illustration and explanation and are not intended as a definition of the limits of embodiments of the disclosure. In the figures:

DETAILED DESCRIPTION

Figure 1:
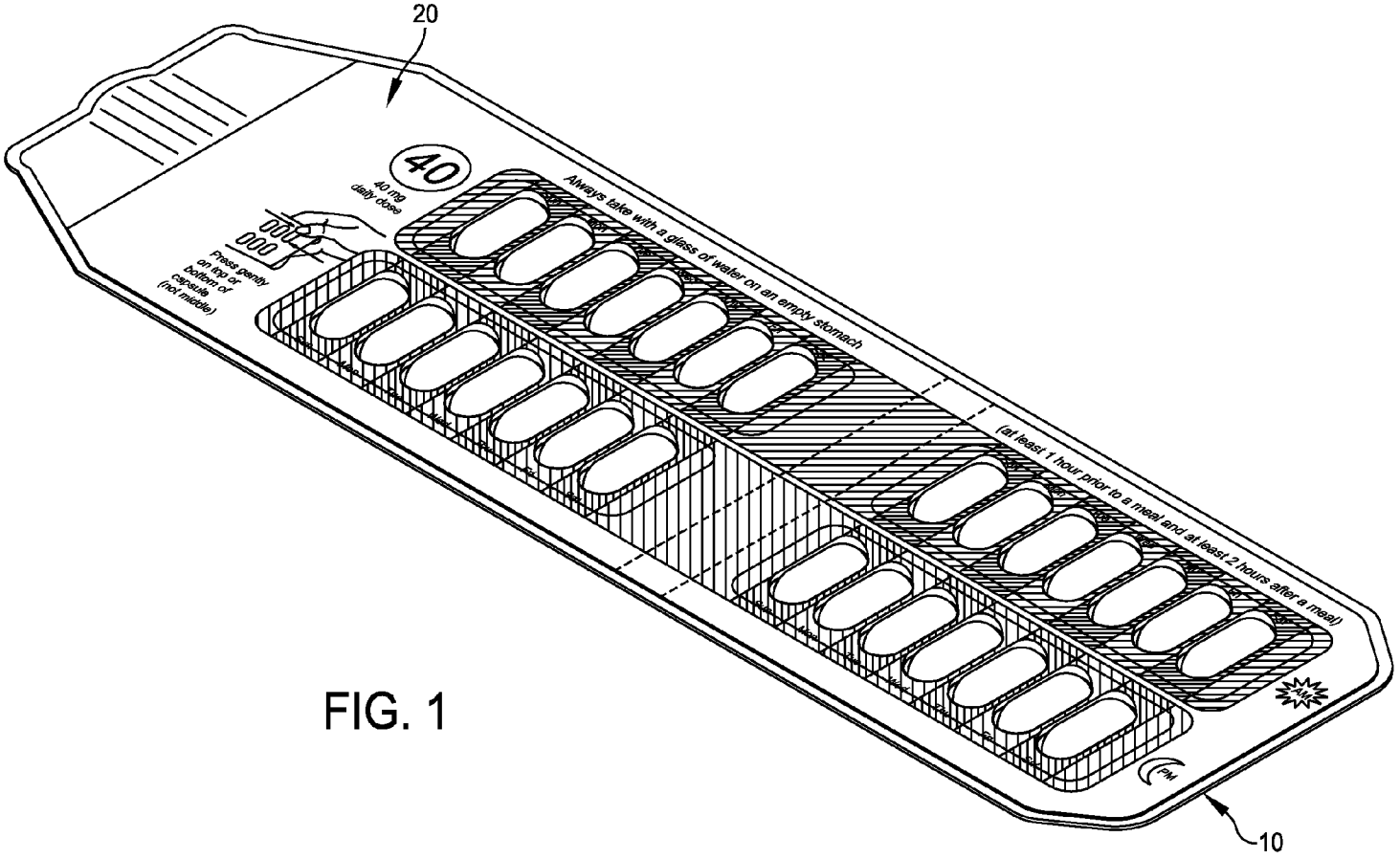
FIG. 1 is a perspective view of a medication card and an overlay of an embodiment of the present disclosure applied to the medication card.

It is to be appreciated that embodiments of the systems and methods discussed herein are not limited in application to the details of construction and the arrangement of components set forth in the following description or illustrated in the accompanying drawings. The methods and apparatuses are capable of implementation in other embodiments and of being practiced or of being carried out in various ways. Examples of specific implementations are provided herein for illustrative purposes only and are not intended to be limiting. In particular, acts, elements and features discussed in connection with any one or more embodiments are not intended to be excluded from a similar role in any other embodiments.

Also, the phraseology and terminology used herein is for the purpose of description and should not be regarded as limiting. Any references to embodiments or elements or acts of the systems and methods herein referred to in the singular may also embrace embodiments including a plurality of these elements, and any references in plural to any embodiment or element or act herein may also embrace embodiments including only a single element. References in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, left and right, top and bottom, upper and lower, and vertical and horizontal are intended for convenience of description, not to limit the present systems and methods or their components to any one positional or spatial orientation.

"Pharmaceutical products" as used herein is used interchangeably with "medicinal products" and includes pills, tablets, capsules, ovules, suppositories, and the like.

Embodiments of the present disclosure are directed to an overlay that can be provided with an unprinted or partially or minimally printed medication card having rows of pills, capsules, tablets, ovules, or suppositories packed in the medication card. As used herein, pharmaceutical or medicinal products in the form of pills, capsules, tablets and the like are used interchangeably and not meant to be limiting. The overlay is provided to provide the consumer instructions for the dosage for ingestion of the pills, capsules or tablets for treatment or the dosage for administration of the ovules or suppositories. As will be apparent as the description of the overlay proceeds, the medication card can be provided in a predetermined format, e.g., four rows of seven pills, capsules or tablets in each row, without any markings or other indicia provided to inform the consumer of dosage instructions, for example. With the overlay, the pharmacy can provide one of several overlays having specific instructions on the overlay for the consumer, thereby enabling the manufacture to mass produce the medication cards without customer-specific or country-specific instructions. The medication card can be unprinted or partially printed. By referencing "partially printed" medication card, some key instructions for the patient are not printed on the card. An example of a key instruction is dosage instructions. The key instructions are provided instead on the overlay.

Figure 2:
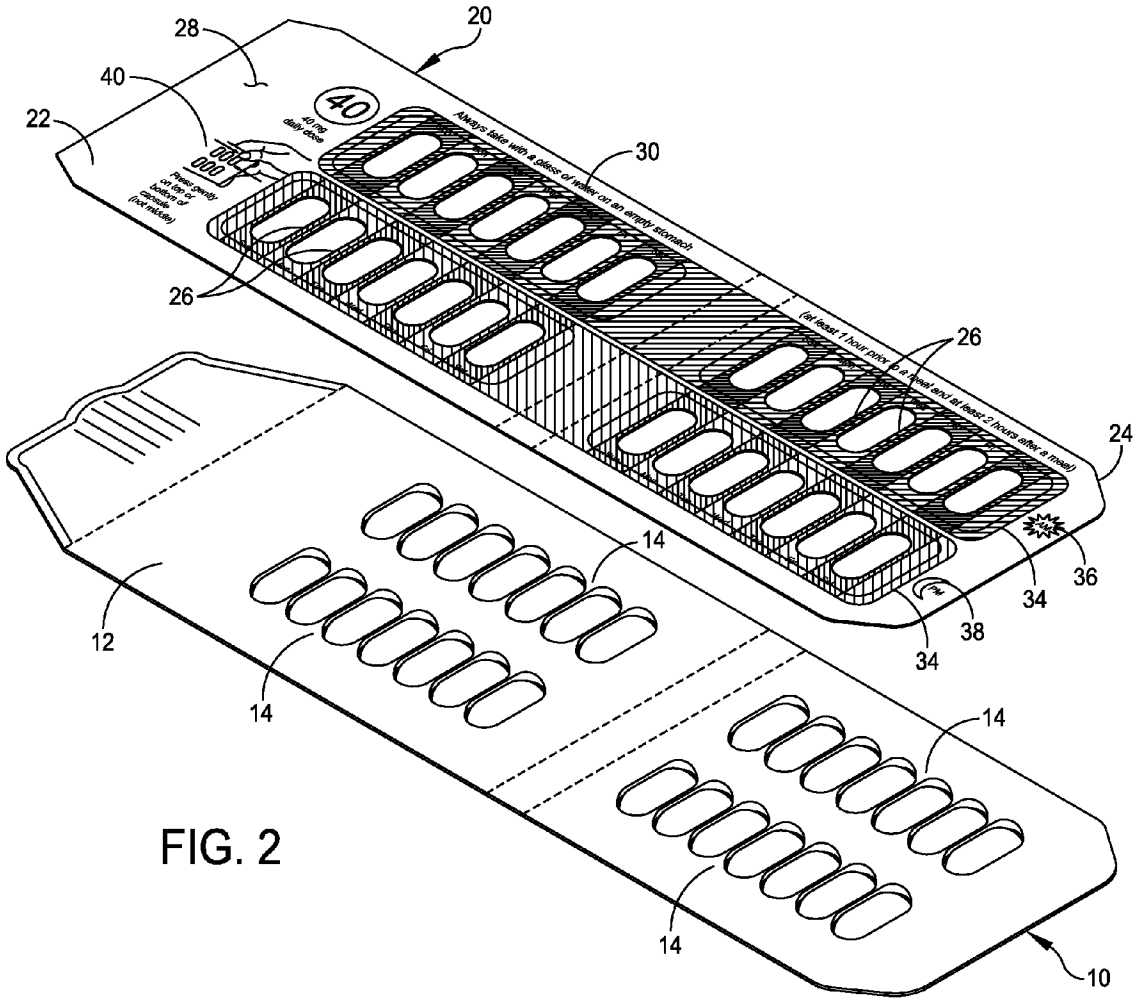
FIG. 2 is an exploded perspective view of the overlay and the medication card prior to applying the overlay on the medication card.

Referring to the drawings, and more particularly to FIGS. 1 and 2, an exemplary medication card is generally indicated at 10. As shown, the medication card 10 includes a carrier sheet 12 having several blisters, each indicated at 14, applied to the carrier sheet. Each blister 14 is shown to have seven pills. Blisters are well known for packaging pharmaceutical products, including pills, tablets, capsules and the like. There are two main processes for blistering—hot and cold. The cold process is based on the use of two aluminum foils to create an aluminum/aluminum blister. The hot process is based on the use of one plastic and one aluminum foil to form the blister.

A typical blister includes a formed sheet having a plurality of cavities or pockets formed in the sheet that are designed to receive pharmaceutical or medicinal products. The blister further includes the pharmaceutical products.

It should be noted that the provision of a blister 14 having seven pills should not be considered as a limitation to the scope of the present disclosure. Seven pills may be a desired amount, representing a single pill to be taken during a single day. The medication card 10 can be provided with any number of pills depending on the intended use of the medicine. Moreover, as mentioned, the pharmaceutical or medicinal compositions can take any number of forms beyond pills, such as capsules and tablets, for example.

As shown, the medication card 10 is generally rectangular in construction having chamfered corners to present an attractive package. In one embodiment, the medication card 10 can be folded in a traditional manner to fit inside an outer card or cover, which together constitutes a wallet for the consumer. It should be noted the medication card 10 can embody any number of different shapes and forms and fall within the scope of the present disclosure. As shown, the carrier sheet 12, which may be fabricated from heavy stock paper or cardboard material, or some other suitable flexible material, such as plastic sheet material. The carrier sheet 12 is generally blank in that it has no printing on the surface of the carrier sheet facing the consumer prior to the consumer removing a pill in a traditional manner or the carrier sheet can be partially printed in the manner described herein. In some embodiments, it should be noted that the medication card can include information in small print that is related to a stock number of the medication card or an expiration date of the pills contained within the medication card.

Referring specifically to FIG. 2, generally indicated at 20 is an overlay of embodiments of the present disclosure for application to the unprinted or partially printed medication card 10. In the shown embodiment, the overlay 20 includes a planar body 22 fabricated from heavy stock paper or cardboard material, or a suitable flexible material, such as plastic. The overlay 20 can be fabricated from any number of processes, including having a label or sticker applied to heavy stock paper or cardboard. The overlay may embody a sticker having a tacky surface that is releasably attached to the medicine card 10. In one embodiment, the overlay 20 has an outer periphery 24 that substantially corresponds to an outer periphery of the carrier sheet 12 of the medication card 10. In another embodiment, the outer periphery 24 of the overlay 20 may be slightly smaller than the outer periphery of the carrier sheet 12 of the medication card 10 so that the overlay lies inboard of the medication card.

The overlay 20 further has a plurality of openings, each indicated at 26, formed in the planar body 22, with locations of the openings substantially corresponding to locations of the pills of the medication card. In the shown embodiment, the overlay 20 has twenty-eight openings 26 formed in the planar body 22, with four rows of seven openings corresponding to the locations of the pills of the blisters 14. Each opening 26 is sized to enable a pill to extend through the opening 26 to expose the pill to the consumer so that the consumer can apply pressure on the pill to release it from the medication card 10 in a traditional manner.

As shown, the overlay 20 further includes instructions provided on a front surface 28 of the planar body 22 of the overlay. The instructions are provided for the consumer, and may include dosage instructions for ingesting the pills provided on the medication card 10. The instructions can include written instructions, e.g., written instructions 30, printed on the front surface 28 of the planar body 22. For example, the written instructions provided on the overlay 20 can include requirements for ingesting the pills, such as "Always take with a glass of water on an empty stomach (at least 1 hour prior to a meal and at least 2 hours after a meal)." The written instructions can further include dosage amounts, such as "40 mg daily dose." Moreover, the written instructions can include text on how the pills are removed from the medication card 10, such as "Press gently on top or bottom of capsule (not middle)."

The type of text provided on the overlay depends of the medicine contained by the medication card 10, the dosage amount to be ingested by the consumer, and recommendations on how to remove the pills from the medication card. For example, the days of the week may be further printed on the front surface 28 of the planar body 22 of the overlay 20 to assign a certain day to a single pill. In the shown embodiment, the truncated representations of the days of the week are provided on the front surface 28 of the overlay 20, i.e., "Sun," "Mon," "Tue," "Wed," "Thu," "Fri," and "Sat."

The instructions can further include color coded instructions printed on the front surface 28 of the planar body 22 of the overlay 20. In a particular embodiment, the color coded instructions includes a first color 32 to designate a first subset of the plurality of pills to be ingested during a first time period and a second color 34 to designate a second subset of the plurality of pills to be ingested during a second time period. For example, the first color 32 can designate that a pill is to be ingested during the morning or "AM" hours and the second color 34 can designate that another pill is to be ingested during the evening or "PM" hours. In one embodiment, the first color 32 can be orange or yellow and designate an upper row of pills provided on the medication card, e.g., fourteen pills. The second color 34 can be blue or black and designate a lower row of pills provided on the medication card, e.g., another fourteen pills. It should be noted that any contrasting color may be used to designate a select group or groups of pills to be ingested at a particular time.

In another embodiment, the first color 32 can include at least two shades of the first color to designate separate days of the week. Similarly, the second color 34 includes at least two shades of the second color to designate separate days of the week. As shown, the two shades of the first color 32 include a darker shade of orange and a lighter shade of orange, with the different shades of orange representing different days of the week for the morning dosage. Likewise, the two shades of the second color 34 include a darker shade of blue and a lighter shade of blue, with the different shades of blue representing different days of the week for the evening dosage. In the shown embodiment, each shade of a single color represents a separate, adjacent day of the week. For example, a darker shade of orange designates "Mon" or Monday and an adjacent lighter shade of orange designates "Tue" or Tuesday. Similarly, a darker shade of blue designates "Mon" or Monday and an adjacent lighter shade of blue designates "Tue" or Tuesday. The number of shaded columns may depend on the amount of pills to be ingested at a particular time from the blister 14.

In another embodiment, the instructions can further include one or more symbols printed on the planar body. As shown, one symbol indicated at 36 designates a first time period and another symbol indicated at 38 designates a second time period. In the shown embodiment, the first symbol 36 designates morning or "AM" dosage and the second symbol 38 designates evening or "PM" dosage. Another symbol, indicated at 40, can be provided to show the consumer how to remove a pill from the medication card 10. Any number of symbols can be provided to instruct the consumer on any number of activities related to ingesting the medicine provided in the medication card within predetermined dosage amounts.

Figure 3:
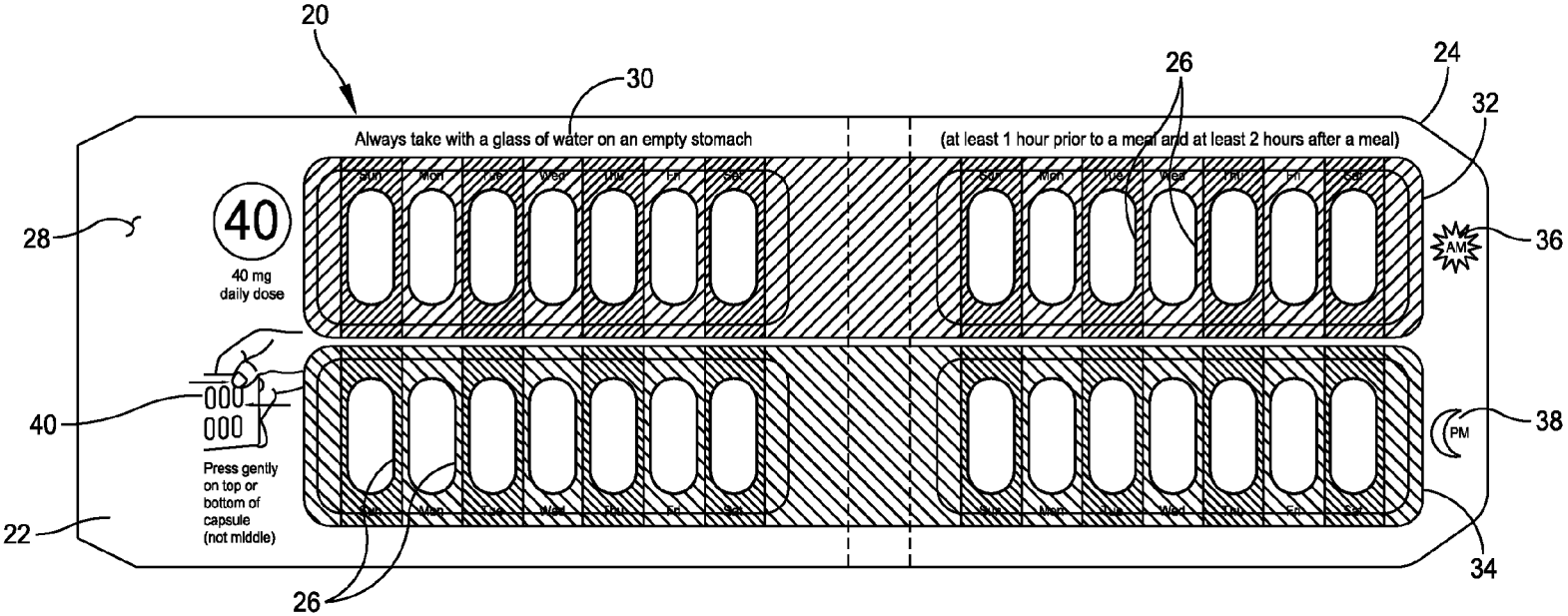
FIG. 3 is a top plan view of an overlay and a medication card having a first exemplary dosage amount printed on the overlay.
Figure 4:
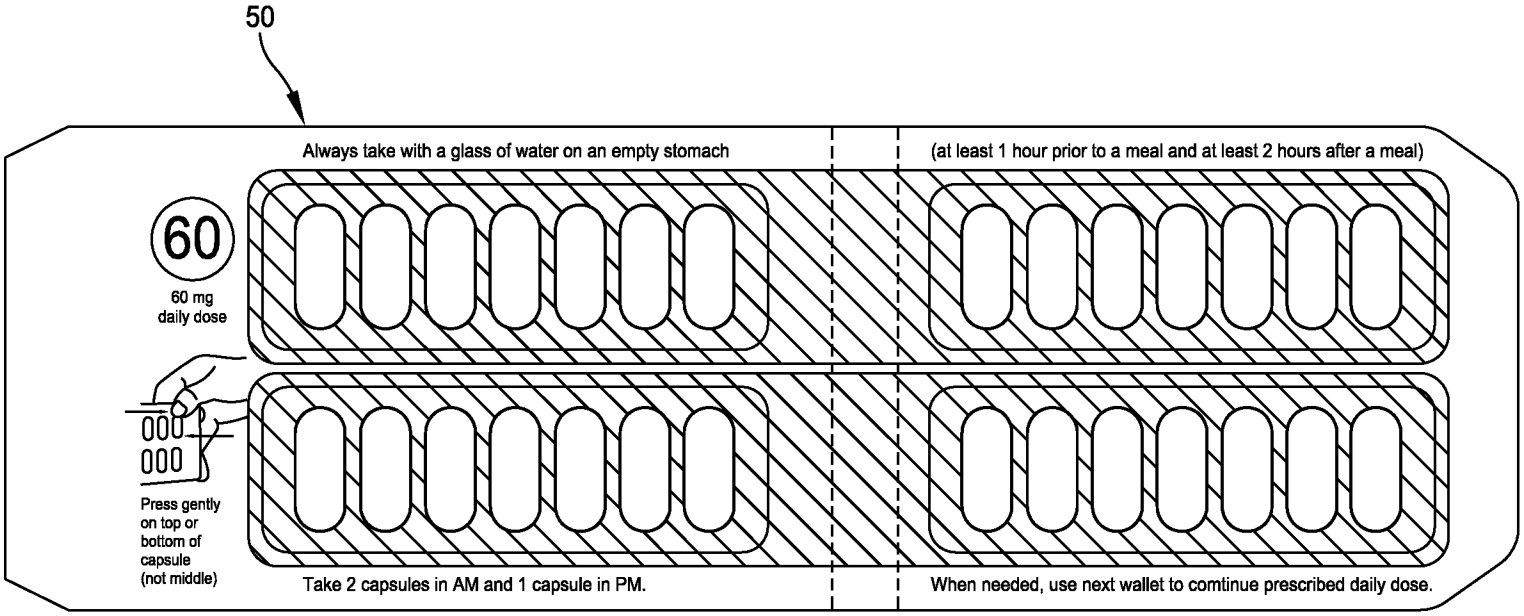
FIG. 4 is a top plan view of an overlay and a medication card having a second exemplary dosage amount printed on the overlay.
Figure 5:
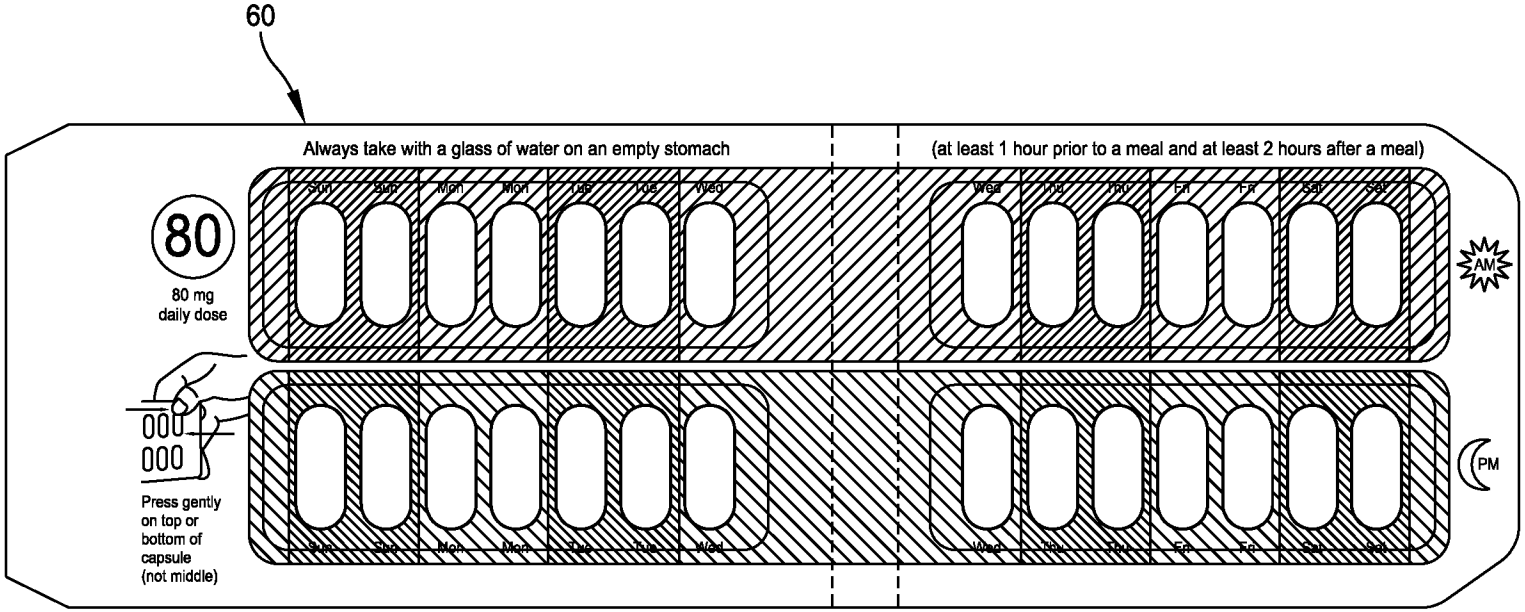
FIG. 5 is a top plan view of an overlay and a medication card having a third exemplary dosage amount printed on the overlay.

Referring to FIGS. 3-5, the overlay can be configured for different dosage amounts to be taken by different consumers. For example, FIG. 3 illustrates the overlay 20 shown in FIGS. 1 and 2 having instructions for a forty milligram (mg) dosage amount in which the consumer ingests two pills per day, one in the AM (morning) and one in the PM (afternoon/evening). As shown, each opening 26 is positioned within a day of the week and a time of day assigned to the pill associated with the opening, which enables the consumer to ingest a certain pill at a certain time on a certain day of the week. For the embodiment shown in FIG. 3, the overlay 20 has twenty-eight openings 26 that receive twenty-eight pills from the medication card 10 for fourteen days of pills, since the consumer ingests two pills per day.

FIG. 4 illustrates an overlay, generally indicated at 50, having instructions for a sixty mg dosage amount in which the consumer ingests three pills per day. In this embodiment, there are no days of the week or color coded time periods assigned to the openings of the overlay 50, since the consumer takes an odd amount of pills per day. Instead, the overlay 50 is provided with detailed instructions to inform the consumer on how many pills to take per day and what to do when the consumer consumes all of the pills provided on the medication card. In the shown embodiment, the overlay 50 includes written instructions stating "Take 2 capsules in AM and 1 capsule in PM. When needed, use next wallet to continue prescribed daily dose." The written instructions provided on the overlay 50 can be tailored to the type and dosage of medicine to be consumed. Alternatively, the three wallets for the 60 mg dose amount each may have a different overlay, with more detailed dosage instructions, to cover in total twenty-eight days of pill consumption.

FIG. 5 illustrates an overlay, generally indicated at 60, having instructions for an eighty mg dosage amount in which the consumer ingests four pills per day, two in the AM (morning) and two in the PM (afternoon/evening). As shown, each opening of the overlay 60 has a day of the week and a time of day assigned to the pill associated with the opening, which enables the consumer to ingest a certain pill or pills at a certain time and day of the week. The shaded portions of the first color and the second color of the overlay 60 represent two pills to be taken in a particular time period for that day. For example, a darker shade of orange designates two pills to be taken on "Mon" or Monday in AM and an adjacent lighter shade of orange designates two pills to be taken on "Tue" or Tuesday in AM. Similarly, a darker shade of blue designates two pills to be taken on "Mon" or Monday in PM and an adjacent lighter shade of blue designates two pills to be taken on "Tue" or Tuesday in PM. For the embodiment shown in FIG. 5, the overlay has twenty-eight openings for twenty-eight pills for seven days of medicine, since the consumer ingests four pills per day.

Figure 6:
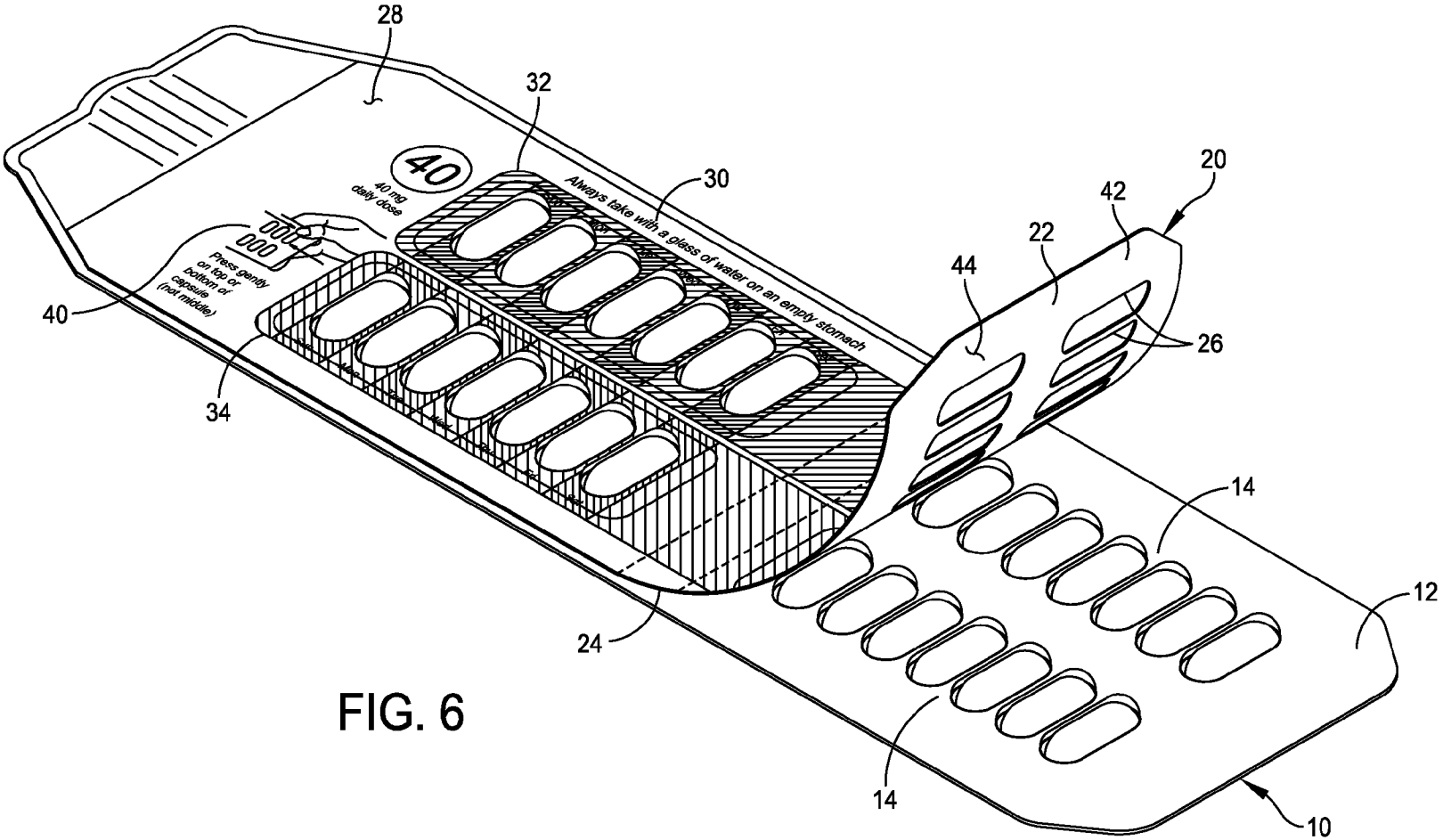
FIG. 6 is a perspective view of the overlay and medication card shown in FIG. 1 with the overlay being partially applied to the medication card.

Referring to FIG. 6, the overlay 20 shown in FIGS. 1-3 further includes an adhesive layer 42 applied on a back surface 44 of the planar body 22. As shown, the adhesive layer 42 is configured to secure the planar body 22 of the overlay 20 to the medication card 10. In one embodiment, the adhesive layer 42 can be a glue or adhesive capable of allowing the removal of the overlay 20 from the medication card 10 and its replacement in case the placement was not accurate when initially placing the overlay on the medication card and reusing the overlay on another medication card. The adhesive should be strong enough to sufficiently secure the overlay 20 on the medication card 10 but weak enough to remove the overlay and replace the overlay in case the initial placement was not correct.

In a certain embodiment, the overlay of embodiments of the present disclosure can be used in connection with an outer card that is used to store a folded medication card and overlay. The overlay can be provided with or separate from the medication card and outer card.

Thus, it should be observed that the overlay of embodiments of the present disclosure is particularly effective in achieving a balanced approach in providing instructions to consumers of medicine by maximizing packaging efficiency while preserving a compliant packaging offered by a capsule wallet package and minimizing the number of variables provided by commercially-available packaging techniques. The overlay enables unprinted or partially printed medication cards to be used to dispense a variety of dosage options. The overlay can be adapted to any number of medication card configurations, thereby enabling manufacturers to produce such cards without instructions.

The overlay of embodiments of the present disclosure can also be applied by pharmacists but also by patients. For example, the pharmacist can apply the overlay on the medication card or the overlay can be provided with the medicine card for application by the patient or the caregiver of the patient.

Having thus described several aspects of at least one embodiment of this disclosure, it is to be appreciated various alterations, modifications, and improvements will readily occur to those skilled in the art. Such alterations, modifications, and improvements are intended to be part of this disclosure, and are intended to be within the spirit and scope of the disclosure. Accordingly, the foregoing description and drawings are by way of example only.

What is claimed is:

1. A medication card assembly comprising:

a medication card including a carrier sheet having a top surface, a first row of blisters, and a second row of blisters, each blister being configured to house a pharmaceutical product, the medication card being provided without key instructions including dosage instructions; and an overlay including a planar body having a front surface and a back surface, the planar body being configured to be applied to the carrier sheet of the medication card with a bottom surface of the planar body of the overlay facing the top surface of the carrier sheet of the medication card, the planar body of the overlay being sized to lie within a boundary defined by the carrier sheet of the medication card, the planar body being separate than and uncoupled with respect to the medication card, the overlay further including a plurality of openings formed in the planar body, locations of the plurality of openings substantially corresponding to locations of the first row of blisters and the second row of blisters, and key instructions provided on the front surface of the planar body for ingesting the plurality of products of the medication card, the key instructions including dosage instructions.

2. The overlay of claim 1, wherein the medication card is unprinted or partially unprinted.

3. The overlay of claim 1, wherein the key instructions further include written instructions printed on the front surface of the planar body.

4. The overlay of claim 3, wherein the key instructions further include color coded instructions printed on the front surface of the planar body.

5. The overlay of claim 4, wherein the color coded instructions includes a first color to designate a first subset of the plurality of products to be ingested during a first time period and a second color to designate a second subset of the plurality of products to be ingested during a second time period.

6. The overlay of claim 5, wherein the first color includes at least two shades of the first color to designate separate days of the week.

7. The overlay of claim 6, wherein the second color includes at least two shades of the second color to designate separate days of the week.

8. The overlay of claim 4, wherein the key instructions further include at least one symbol printed on the front surface of the planar body.

9. The overlay of claim 8, wherein the at least one symbol designates one of a first time period and a second time period.

10. The overlay of claim 1, wherein each of the plurality of openings is sized to enable a product to extend through the opening.

11. The overlay of claim 1, wherein the overlay can be configured for different dosages.

* * * * *